US008668454B2

(12) United States Patent
Wiebe

(10) Patent No.: US 8,668,454 B2
(45) Date of Patent: Mar. 11, 2014

(54) TURBINE AIRFOIL FILLET COOLING SYSTEM

(75) Inventor: David J. Wiebe, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1026 days.

(21) Appl. No.: 12/716,548

(22) Filed: Mar. 3, 2010

(65) Prior Publication Data

US 2011/0217179 A1 Sep. 8, 2011

(51) Int. Cl.
*F01D 5/18* (2006.01)

(52) U.S. Cl.
USPC ..... 416/97 R

(58) Field of Classification Search
USPC ..... 415/115; 416/95, 96 R, 97 R, 97 A
See application file for complete search history.

(56) References Cited

U.S. PATENT DOCUMENTS

| | | | | |
|---|---|---|---|---|
| 3,950,113 | A * | 4/1976 | Albrecht | 416/97 A |
| 6,341,939 | B1 * | 1/2002 | Lee | 416/97 R |
| 6,884,029 | B2 * | 4/2005 | Beeck | 415/191 |
| 7,097,417 | B2 * | 8/2006 | Liang | 415/115 |
| 7,131,817 | B2 * | 11/2006 | Keith et al. | 416/97 R |
| 7,597,536 | B1 * | 10/2009 | Liang | 415/138 |
| 7,621,718 | B1 * | 11/2009 | Liang | 415/115 |
| 7,841,828 | B2 * | 11/2010 | Liang | 415/191 |
| 8,398,364 | B1 * | 3/2013 | Liang | 415/115 |
| 2006/0153681 | A1 * | 7/2006 | Lee et al. | 416/97 R |

* cited by examiner

*Primary Examiner* — Nathaniel Wiehe
*Assistant Examiner* — Ryan Ellis

(57) ABSTRACT

A cooling system for the fillet of a turbine blade is provided. The blade includes an airfoil transitioning to a platform having a flow path surface. The transition region is defined by a fillet. A cooling passage is formed in the platform and extends about at least a portion of the periphery of the airfoil. The cooling passage is located proximate to the flow path surface and is substantially aligned with at least a portion of the fillet. Coolant is delivered to the passage by a supply hole, which can reduce the temperature in the fillet region. As a result, thermal gradients in the fillet region can be minimized, which can reduce thermal stresses. An exhaust hole extends between the passage and the flow path surface of the platform. Thus, coolant discharged from the exhaust holes enters the flow path of the turbine.

7 Claims, 4 Drawing Sheets

TURBINE AIRFOIL FILLET COOLING SYSTEM

FIELD OF THE INVENTION

The invention relates in general to turbine engines, and, more particularly, to turbine airfoils.

BACKGROUND OF THE INVENTION

A turbine engine has a compressor section, a combustor section and a turbine section. In operation, the compressor section can induct air and compress it. The compressed air can enter the combustor section where it can be mixed with fuel. The air-fuel mixture is ignited, thereby forming a high temperature working gas. The high temperature working gas is routed to the turbine section where it passes rows of stationary airfoils, known as vanes, alternating with rows of rotating airfoils, known as blades.

The turbine blades and vanes are exposed to these high temperatures. Consequently, these components require cooling to prolong their life and reduce the likelihood of failure as a result of excessive temperatures. FIG. 1 shows a typical turbine blade 1. The turbine blade 1 has a root portion 2 and a platform 3. An elongated airfoil 4 extends radially outward from the platform 3. A transition region 5 between the airfoil 4 and the platform 3 is typically configured as a fillet 6. It should be noted that turbine vanes also typically include a fillet in the transition region between the airfoil and the shroud.

The fillet 6 is one area of the blade 1 that is particularly difficult to cool because of several factors. The fillet 6 is subjected to high centrifugal forces during engine operation. In order to handle such forces, the fillet 6 is generally thicker than neighboring sections of the platform 3 and of the airfoil 4. However, the greater material thickness in the region of the fillet 6 can result in high thermal gradients. The outside surface of the fillet 6 is very hot because it is exposed to the hot gases in the turbine flow path; however, the inside portion in the region of the fillet 6 is cooler due to the relatively large material thickness. As a result of such thermal gradients, the fillet 6 can experience high thermal-induced stresses. Consequently, these high stresses can cause the fillet region to be a common failure area in turbine blades.

Thus, there is a need for a system that can effectively cool the fillet region of a turbine airfoil and/or minimize high thermal gradients in the fillet region of a turbine airfoil.

SUMMARY OF THE INVENTION

In one aspect, embodiments of the invention are directed to an airfoil fillet cooling system for a turbine component, which can be a turbine vane or a turbine blade. The component includes an airfoil and an end wall having a flow path surface. The airfoil transitions to the end wall in a region defined by a fillet. One or more cooling passages are formed in the end wall and extend about at least a portion of the airfoil. The one or more cooling passages are located proximate to the flow path surface and substantially aligned with at least a portion of the fillet.

In one embodiment, the one or more cooling passages can comprise a single cooling passage that extends continuously about the airfoil. In another embodiment, the one or more cooling passages can be a plurality of cooling passages. In such case, each cooling passage can extend about a portion of the airfoil.

One or more supply holes extend through the turbine component between the passage and a coolant source. Thus, fluid communication is between the passage and the coolant source. The coolant source can be a chamber defined in part by an inner side of the end wall. The coolant source can include a coolant, which can be, for example, air.

One or more exhaust holes extend through the turbine component between the passage and the outside of the turbine component. Thus, fluid communication is permitted between the passage and the outside of the turbine component. Each supply hole can be larger than each exhaust hole. The quantity of exhaust holes can be greater than the quantity of supply holes associated with each cooling passage. The one or more supply holes can be offset from the one or more exhaust holes. Each of the exhaust holes can have an outlet, which can be on the flow path surface of the end wall. The outlet can be located proximate to the fillet. Alternatively or in addition, the outlet can be oriented away from the fillet.

In another respect, embodiments of the invention are directed to an airfoil fillet cooling system for a turbine component. The turbine component can be a turbine vane or a turbine blade. The component includes an airfoil and an end wall having a flow path surface. One or more slots are formed in the end wall. In one embodiment, the one or more slots can be a single slot that extends continuously about the airfoil. In another embodiment, the one or more slots can be a plurality of slots. Each slot can extend about a portion of the airfoil.

The one or more slots are configured such that a shelf is formed in the end wall. The shelf defines at least a part of the flow path surface. The one or more slots are further configured such that the airfoil transitions to a portion of the end wall in a region defined by a fillet. The fillet is located below the flow path surface. The slot is open to the flow path surface of the end wall. An opening can be defined between the shelf and the airfoil.

One or more supply holes extend through the turbine component. Each supply hole extends between a slot and a coolant source so as to permit fluid communication between them. The coolant source can be a chamber defined in part by an inner side of the end wall. The coolant source can include a coolant, which can be, for example, air. The at least one supply hole is positioned such that a coolant exiting at least the supply hole impinges on the shelf.

DETAILED DESCRIPTION OF EMBODIMENTS OF THE INVENTION

Embodiments of the invention are directed to cooling systems for turbine airfoil fillets. Aspects of the invention will be explained in connection with a turbine blade, but the detailed description is intended only as exemplary. Indeed, it will be appreciated that aspects of the invention can be applied to turbine vanes as well. Embodiments of the invention are shown in FIGS. 2-3, but the present invention is not limited to the illustrated structure or application.

Figure 1:
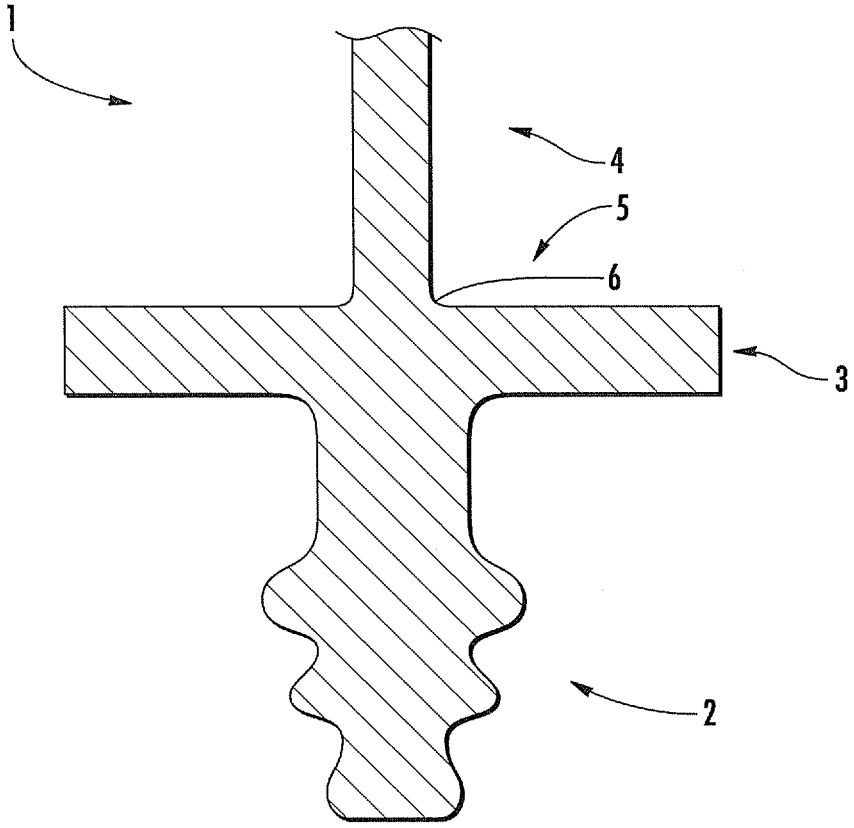
FIG. 1 (PRIOR ART)
FIG. 1 is a side elevation cross-sectional view of a known turbine airfoil.
Figure 2:
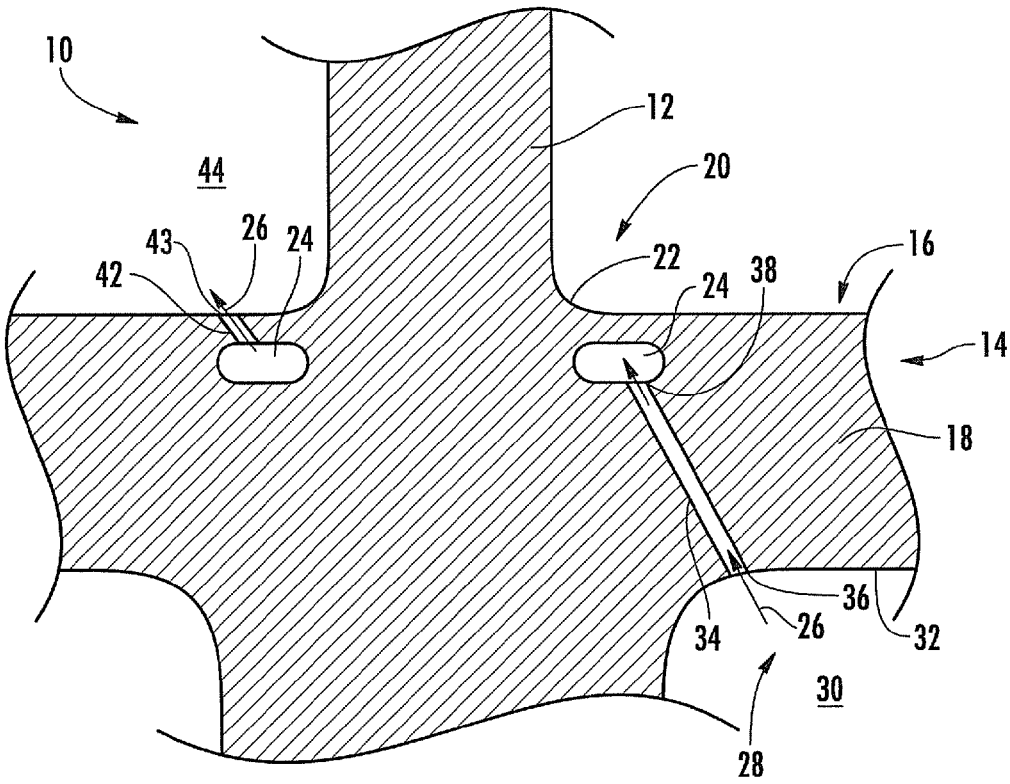
FIG. 2 is a side elevation cross-sectional view of a turbine airfoil having a first fillet cooling system according to aspects of the invention.
Figure 3:
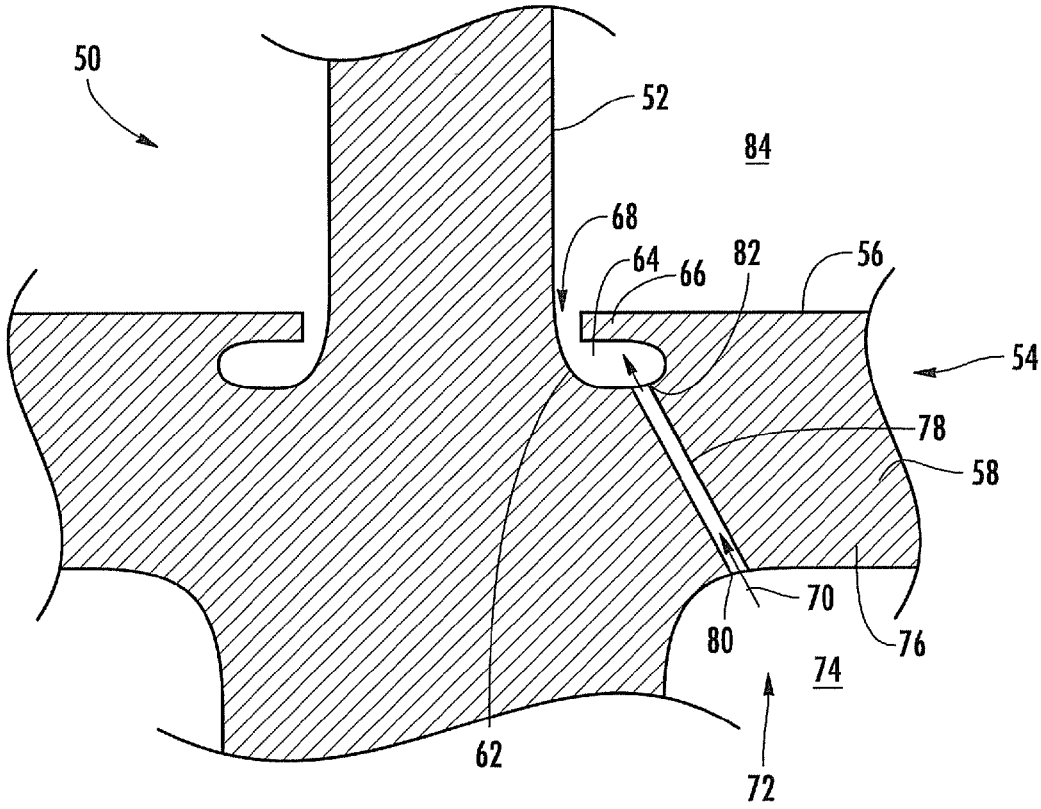
FIG. 3 is a side elevation cross-sectional view of a turbine airfoil having a second fillet cooling system according to aspects of the invention.

Referring to FIG. 2, a first embodiment of a fillet cooling system according to aspects of the invention is shown. A turbine component 10 includes an airfoil 12 and an end wall 14 having a flow path surface 16. When the component 10 is a turbine blade, the end wall 14 can be a platform 18. When the component 10 is a turbine vane, the end wall 14 can be a shroud. The airfoil 12 can transition to the end wall 14 in a region 20 defined by a fillet 22. Generally, there is no change to the location of the fillet 22 from the fillet locations in existing blade or vane designs. According to aspects of the invention, one or more passages 24 can be formed in the end wall 14. The at least one passage 24 can be located proximate the flow path surface 16 of the end wall 14. For instance, the at least one passage can be at a depth from about 2 millimeters to about 6 millimeters radially inward from the flow path surface 16. The at least one passage 24 can be generally aligned with the fillet 22, as is shown in FIG. 2.

In one embodiment, there can be a single passage 24 extending continuously about the entire periphery of the airfoil 12. In such case, the passage 24 can follow a generally airfoil-shaped path. In another embodiment, there can be a plurality of separate passages 24 with each passage 24 extending along a portion of the periphery of the airfoil 12. In some instances, the individual passages 24 can be selectively provided in areas requiring thermal stress reduction. The passages 24 can be formed in any suitable manner, such as by casting or machining.

The passages 24 can have any suitable size and shape. In one embodiment, the passages 24 can be circular or oval. However, other geometries are possible, including, for example, rectangular, triangular, trapezoidal, semicircular, polygonal and parallelogram. The shape of the passage 24 can be substantially the same along the length of the passage 24. Alternatively, the shape of the passage 24 can be different in one or more areas along the length of the passage 24. Further, the size of the passage 24 can be the same along the length of the passage 24, or the size of the passage 24 can be different in one or more locations along its length. The cross-sectional area of the passage 24 can be substantially constant along the length of the passage 24, or the cross-sectional area can be different in one or more locations along the length of the passage 24. In the case of a plurality of passages, the passages 24 can be substantially identical to each other, or at least one of the passages 24 can be different from the other passages in one or more respects, such as in size, shape, cross-sectional area, length, width, depth from the flow path surface and location relative to the fillet region, just to name a few possibilities.

A coolant 26 can be supplied to the passage 24. The coolant 26 can be any suitable coolant, including, for example, air. The coolant 26 can be received from a coolant source 28. In one embodiment, the coolant source 28 can be a cooling chamber 30 defined in part by an inner side 32 of the end wall 14. Alternatively, the coolant source 28 can be an inner passage (not shown) of the airfoil 12.

The cooling source 28 can be in fluid communication with the one or more passages 24 by at least one supply hole 34 extending therebetween. The at least one supply hole 34 can extend through any suitable portion the component 10. For instance, when the component 10 is a turbine blade, the at least one supply hole 34 can extend through the root and/or platform 18 of the blade. The supply holes 34 can have an inlet 36 and an outlet 38. The supply holes 34 can be formed in any suitable way, including, for example, by machining or casting. The outlet 38 of each supply hole 34 can be provided in any suitable portion of the passage 24. For instance, the outlets 38 can be provided in a generally central region of the passage 24. Alternatively, the outlets 38 can be provided proximate to one of the ends of the passage 38. The outlet can be on an inner surface of the passage 24, as is shown in FIG. 2. The term "inner" means relative to the axis of the turbine.

There can be any quantity of supply holes 34. For example, there can be a single supply hole 34 associated with each passage 24. Alternatively, there can be a plurality of supply holes 34 associated with each passage 24. When there is a plurality of passages 24, the quantity of supply holes 34 associated with one passage 24 can be the same as the quantity of supply holes 34 associated with one or more of the other passages 24. Alternatively, the quantity of supply holes 34 associated with one passage 24 can be the different than the quantity of supply holes 34 associated with one or more of the other passages 24. If a plurality of supply holes 34 is associated with each passage 24, the supply holes 34 can be arranged in any suitable manner. For example, the supply holes 34 can be equally spaced, or one or more of the supply holes 34 can have a different spacing from the other supply holes 34. The outlets 38 of the supply holes 34 can be generally aligned along the passage 24, or at least one of the outlets 38 can be offset from the other outlets 38.

The supply holes 34 can have any suitable shape. For instance, the supply holes 34 can be generally circular, oval, rectangular, triangular, trapezoidal, polygonal, parallelogram or semicircular, just to name a few possibilities. When a plurality of supply holes 34 is provided, the supply holes 34 can have the same shape, or at least one of the supply holes 34 can have a different shape from the other supply holes 34.

The supply holes 34 can extend at any suitable angle relative to the flow path surface 16 of the end wall 14. For instance, the supply holes 34 can extend at about 90 degrees or less relative to the flow path surface 16 of the end wall 14. In at least some instances, the geometries in the particular area may factor into the angle of the supply holes 34. The supply holes 34 may all extend at the same angle relative to the flow path face 16, or at least one of the supply holes 34 can extend at a different angle relative to the flow path face 16 than the other supply holes 34.

The supply holes 34 can be substantially straight, as shown. Alternatively, the supply holes 34 may be non-straight, having one or more bends, curves, turns or other non-straight features.

The supply holes 34 can have any suitable size. In the case of multiple supply holes 34, the supply holes 34 can all be substantially the same size. Alternatively, one or more of the supply holes 34 can be different from the rest of the supply holes 34. Further, the cross-sectional area of each supply hole 34 can be substantially constant, or it can vary over at least a portion of its length.

Coolant 26 from the coolant source 28 can enter the inlet 36 of each supply holes 34 and exit through the outlet 38 and flow into the passage 24. The coolant 26 can flow along at least a portion of the passage 26, thereby providing cooling to at least the fillet region 20. The coolant 26 can flow out of the passage 24 through one or more exhaust holes 42. The passage 24 can be in fluid communication with the flow path 44 of the turbine by at least one exhaust hole 42 extending therebetween. The exhaust holes 42 can extend through the any suitable portion of the component 10. For instance, when the component 10 is a turbine blade, the exhaust holes 42 can extend through the platform 18 of the blade. The exhaust holes 42 can be formed in any suitable way, including, for example, by machining or casting.

The exhaust holes 42 can have any suitable size, shape, quantity, spacing and path. The exhaust holes 42 can extend at any suitable angle relative to the flow path face 16 of the end wall 14. The exhaust holes 42 can be straight or non-straight. The above discussion of the supply holes 34 can apply equally to the exit holes 42. Each exhaust hole 42 can have an associated outlet 43. At least one of the exhaust holes 42 can be oriented such that its associated outlet 43 is proximate to but generally facing away from the fillet 22, as is shown in FIG. 2.

The supply holes 34 and the exhaust holes 42 can be the substantially identical to each other, or the supply holes 34 and the exhaust holes 42 can be different in one or more respects. The supply holes 34 and the exhaust holes 42 can be configured such that coolant flow can be strategically metered into the passage 24 to reduce the temperature of the fillet 22 without locally overcooling the fillet 22 and locally increasing the thermal stresses. The supply holes 34 can be generally larger than the exhaust holes 42. Alternatively or in addition, the quantity of exhaust holes 42 can be greater than the quantity of supply holes 34 associated with the passage 24. In one embodiment, the supply holes 34 and the exhaust holes 42 can be arranged so that they are offset from each other to minimize the likelihood of coolant 26 entering an exhaust hole 42 immediately upon leaving the supply hole 34. Thus, the coolant 26 can flow along at least a portion of the length of the passage 24.

Coolant 26 exiting the passage 24 can cool the end wall 14 near the fillet 22 which can reduce the temperature in the fillet 22 as well as thermal stresses. The coolant 26 that is discharged from the exhaust holes 42 can enter the flow path 44 of the turbine.

A second embodiment of a fillet cooling system according to aspects of the invention is shown in FIG. 3. The turbine component 50 includes an airfoil 52 and an end wall 54 having a flow path surface 56. When the component 50 is a turbine blade, the end wall 54 can be a platform 58. When the component 50 is a turbine vane, the end wall 54 can be a shroud.

According to aspects of the invention, a slot 64 can be formed in the end wall 54. The slot 64 can open to the flow path surface 56 of the end wall 54. As a result, the fillet 62 is moved below the flow path surface 56 of the end wall 54. The slot 64 can be formed in any suitable manner, such as by casting or machining.

Figure 4:
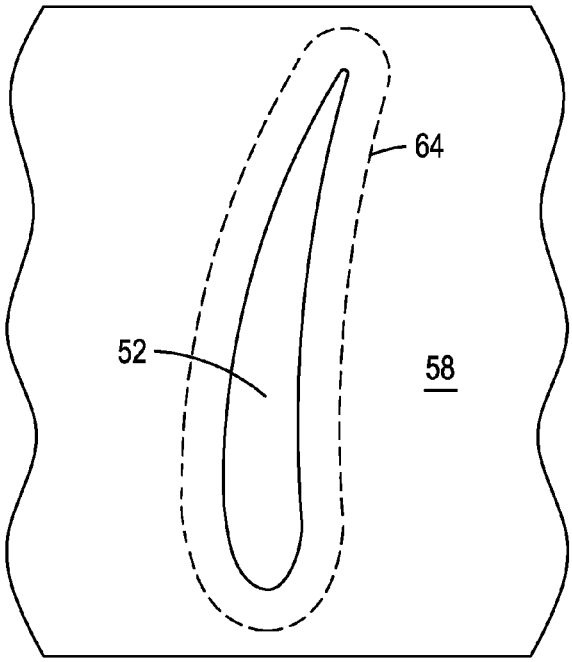
FIG. 4 illustrates a top view of a turbine airfoil with a single slot extending continuously about the periphery of the airfoil.
Figure 5:
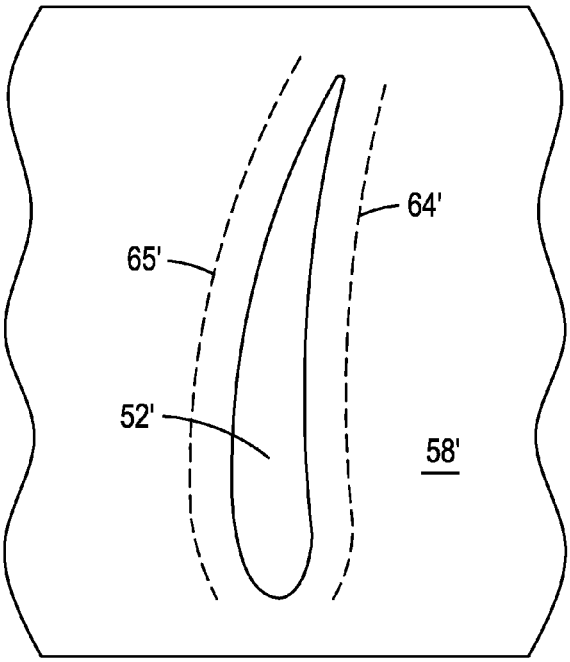
FIG. 5 illustrates a top view of a turbine airfoil with a pair of separate slots each extending along a portion of the periphery of the airfoil.

As illustrated in FIG. 4, ink one embodiment there can be a single slot 64 extending continuously about the entire periphery of the airfoil 52. In such case, the slot 64 can follow a generally airfoil-shaped path. As illustrated in FIG. 5, in another embodiment there can be a plurality of separate slots 64', 65' with each slot 64', 65' extending along a portion of the periphery of the airfoil 52', where the airfoil 52' transitions to the platform 58'. In some instances, the individual slots 64', 65' can be selectively placed in only those areas that require cooling and thermal stress reduction.

The one or more slots 64 can have any suitable conformation. In the case of a plurality of slots 64', 65', the slots 64', 65' can be substantially identical, or at least one of the slots 64' can be different from the other slots 65' in one or more respects. The slot 64 can be generally round, egg, oblong, pear or oval shaped. The slot 64 can be defined in part by the airfoil 52. The slot 64 can be configured such that a shelf 66 is formed by a portion of the end wall 54 that overhangs the slot 64. The shelf 66 can partially shield the slot 64 from the flow path 84.

The slot 64 can also be partly defined by the fillet 62. Significantly, the fillet 62 can have a larger radius than conventional fillets. For example, the radius of the fillet 62 can be about two times larger than the radius of a conventional fillet. In one embodiment, the fillet radius can range from about 4 millimeters for a small turbine blade to about 12 millimeters for a large turbine blade. The slot 64 can have an opening 68 in an outer end portion thereof. The term "outer" means relative to the axis of the turbine. The opening 68 can be defined between the airfoil 52 and the shelf 66. The opening 68 can have any suitable width. For instance, the width of the opening 68 can be sized to provide a desired exit velocity for the coolant 70 and/or to provide a desired distribution of coolant about the periphery of the airfoil 52. Thus, the opening 68 can be substantially identical about the periphery of the airfoil, or it can be different in one or more locations.

A coolant 70 can be supplied to the slot 64. The coolant 70 can be any suitable coolant, including, for example, air. The coolant 70 can be received from a coolant source 72. In one embodiment, the coolant source 72 can be a chamber 74 defined in part by an inner side 76 of the end wall 54. Alternatively, the coolant source 72 can be an inner passage (not shown) of the airfoil 52.

The coolant source 72 can be in fluid communication with the one or more slots 64 by at least one supply hole 78 extending therebetween. The at least one supply hole 78 can extend through any suitable portion the component 50. For instance, when the component 50 is a turbine blade, the at least one supply hole 78 can extend through the root and/or platform 58 of the blade. The supply holes 78 can have an inlet 80 and an outlet 82. The supply holes 78 can be formed in any suitable way, including, for example, by machining or casting. The outlet 82 of each supply hole 78 can be provided in any suitable portion of the slot 64. For instance, one or more outlets 82 can be provided in a generally central region of the slot 64. Alternatively, the outlets 82 can be provided proximate to one of the end regions of the slot 64. The outlets 82 can be on an inner surface of the slots 64. The outlets 82 can be oriented such that coolant 70 exiting the supply holes 78 can provide cooling to the shelf 66.

There can be any quantity of supply holes 78. For example, there can be a single supply hole 78 associated with each slot 64. Alternatively, there can be a plurality of supply holes 78 associated with each slot 64. When there is a plurality of slots 64', 65', the quantity of supply holes 78 associated with one slot 64' can be the same as the quantity of supply holes 78 associated with one or more of the other slots 65'. Alternatively, the quantity of supply holes 78 associated with one slot 64' can be different than the quantity of supply holes 78 associated with one or more of the other slots 65'. If a plurality of supply holes 78 is associated with each slot 64, the supply holes 78 can be arranged in any suitable manner. For example, the supply holes 78 can be equally spaced, or one or more of the supply holes 78 can have a different spacing from the other supply holes 78. The outlets 82 of the supply holes 78 can be generally aligned along the slot 64, or at least one of the outlets 82 can be offset from the other outlets 82.

The supply holes 78 can have any suitable shape. For instance, the supply holes 78 can be generally circular, oval, rectangular, triangular, trapezoidal, polygonal or semicircular, just to name a few possibilities. When a plurality of supply holes 78 is provided, the supply holes 78 can have the same shape, or at least one of the supply holes 78 can have a different shape from the other supply holes 78.

The supply holes 78 can extend at any suitable angle relative to the flow path surface 56 of the end wall 54. For instance, the supply holes 78 can extend at about 90 degrees or less relative to the flow path surface 56 of the end wall 54. In at least some instances, the geometry of components in the particular area may affect the angle that the supply holes 78 extend relative to the flow path surface 56 of the end wall 54. The supply holes 78 may all extend at the same angle relative to the flow path face 56, or at least one of the supply holes 78 can extend at a different angle relative to the flow path face 56 than the other supply holes 78.

The supply holes 78 can be substantially straight, as shown. Alternatively, the supply holes 78 may be non-straight, having one or more bends, curves, turns or other non-straight features.

The supply holes 78 can have any suitable size. In the case of multiple supply holes 78, the supply holes 78 can all be substantially the same size. Alternatively, one or more of the supply holes 78 can be different from the rest of the supply holes 78. Further, the cross-sectional area of each supply hole 78 can be substantially constant, or it can vary over at least a portion of its length.

Coolant 70 from the coolant source 72 can enter the inlet 80 of each supply holes 78 and exit through the outlet 82. The coolant 70 can impinge on the shelf 66. As a result, the coolant 70 can provide cooling to the shelf 66. Further, the pressure of the coolant 70 can be at least partially diffused. In one embodiment, substantially no vortices are formed by the coolant in the slot 64.

The coolant 70 can pass along at least a portion of the slot 64, thereby providing cooling to the fillet 62. Eventually, the coolant 70 will exit through the slot opening 68, where the coolant 70 will join the flow path 84 in the turbine. The coolant 70 can prevent hot gas from the flow path 86 from entering the slot 64. In some instances, the quantity of supply holes 78 can be minimized to avoid overcooling the region and to save the coolant 70 for other beneficial uses in the engine.

The fillet 62 can be effectively cooled because it has been moved away from the flow path 84 and is shielded from the hot gases in the flow path 84 by the shelf 66. Further, the fillet 62 is cooled by the coolant 70 in the slot 64. The fillet 62 can have a sufficiently large fillet radius to avoid stress concentrations due to tight radii or sharp corners. Likewise, the outer end of the slot 64 also has a sufficiently large fillet radius to avoid stress concentrations due to tight radii or sharp corners.

Fillet cooling systems in accordance with aspects of the invention can provide numerous benefits. For instance, such systems can reduce the temperature of the metal of the blade in the region of the fillet. It can reduce the temperature on the outer surface of the fillet, which, in turn, can reduce the thermal gradient through the thickness of the metal at the fillet. Reductions in the thermal gradient can reduce the thermal induced stresses that cause severe low cycle fatigue for every thermal cycle (start-up and shut-down) of the blade. Further, materials used in turbine vane and blade constructions have higher strength at lower temperatures. Thus, by reducing the metal temperature at the fillet, the metal in the fillet region has an increased capability to withstand stress, thereby improving the low cycle fatigue capability of the metal.

The foregoing description is provided in the context of one possible application for the system according to aspects of the invention. While the above description is made in the context of a turbine blade, it will be understood that the system according to aspects of the invention can be applied to other turbine engine components, such as turbine vanes. Thus, it will of course be understood that the invention is not limited to the specific details described herein, which are given by way of example only, and that various modifications and alterations are possible within the scope of the invention as defined in the following claims.

What is claimed is:

1. An airfoil fillet cooling system for a turbine component comprising:

an airfoil;

an end wall having a flow path surface;

at least one slot formed in the end wall, the at least one slot being configured such that the end wall includes a shelf that defines a portion of the end wall that overhangs the at least one slot and said shelf further defines at least a part of the flow path surface, the at least one slot further being configured such that the airfoil transitions to a portion of the end wall in a region defined by a fillet, the fillet being located below the flow path surface, the slot being open to the flow path surface of the end wall and defined by an opening between the shelf and the airfoil;

at least one supply hole extending through the turbine component and between the at least one slot and a coolant source so as to permit fluid communication therebetween, the at least one supply hole being positioned such that a coolant exiting at least the supply hole impinges on the shelf.

2. The fillet cooling system of claim 1 wherein the at least one slot comprises a single slot that extends continuously about the airfoil.

3. The fillet cooling system of claim 1 wherein the at least one slot comprises a plurality of slots, wherein each slot extends about a portion of the airfoil.

4. The fillet cooling system of claim 1 wherein the turbine component is a turbine vane.

5. The fillet cooling system of claim 1 wherein the turbine component is a turbine blade.

6. The fillet cooling system of claim 1 wherein the coolant source is a chamber defined in part by an inner side of the end wall.

7. The fillet cooling system of claim 1 wherein the coolant source includes a coolant, wherein the coolant is air.

* * * * *